US009328722B2

(12) United States Patent
Kaibel et al.

(10) Patent No.: US 9,328,722 B2
(45) Date of Patent: May 3, 2016

(54) METERING SYSTEM AND METERING PUMP THEREFOR

(71) Applicant: ProMinent GmbH, Heidelberg (DE)
(72) Inventors: Jens Kaibel, Lampertheim-Hofheim (DE); Joachim Schall, Fellbach (DE)
(73) Assignee: ProMinent GmbH, Heidelberg (DE)

( * ) Notice: Subject to any disclaimer, the term of this patent is extended or adjusted under 35 U.S.C. 154(b) by 0 days.

(21) Appl. No.: 14/412,695
(22) PCT Filed: Jul. 25, 2013
(86) PCT No.: PCT/EP2013/065756
§ 371 (c)(1),
(2) Date: Jan. 5, 2015
(87) PCT Pub. No.: WO2014/016388
PCT Pub. Date: Jan. 30, 2014

(65) Prior Publication Data
US 2015/0159639 A1 Jun. 11, 2015

(30) Foreign Application Priority Data
Jul. 27, 2012 (DE) ..... 10 2012 106 848

(51) Int. Cl.
*G01F 1/34* (2006.01)
*F04B 13/00* (2006.01)
*F04B 15/02* (2006.01)
*F04B 53/06* (2006.01)

(52) U.S. Cl.
CPC ..... *F04B 13/00* (2013.01); *F04B 15/02* (2013.01); *F04B 53/06* (2013.01)

(58) Field of Classification Search
CPC ..... G01F 1/34; G01F 1/28
USPC ..... 73/861.59, 861.74
See application file for complete search history.

(56) References Cited

U.S. PATENT DOCUMENTS 3,330,218 A * 7/1967 Bumstead ..... F04B 13/00 137/209
2004/0062662 A1 4/2004 Claude
(Continued)

FOREIGN PATENT DOCUMENTS

DE 3238421 A1 5/1983
DE 19623537 A1 12/1997
(Continued)

OTHER PUBLICATIONS

Hans-Jurgen Ziegler, European Patent Office, International Search Report, Nov. 10, 2013.
(Continued)

*Primary Examiner* — Jewel V Thompson
(74) *Attorney, Agent, or Firm* — Paul & Paul

(57) ABSTRACT

The present invention relates to a metering system for metering a liquid metering medium, with a suction line, which is filled with a metering medium at the liquid pressure $p_s$, and a pressure line, which is filled with the metering medium at the liquid pressure wherein the suction line is connected to the pressure line by a metering member configured as a metering pump, with which metering medium can be conveyed from the suction line into the pressure line, wherein the metering pump has a conveying chamber, the volume of which can be changed with the aid of a movable displacement element in such a way that, in a first position of the displacement element, the conveying chamber has a minimum volume $V_{min}$ and, in a second position of the displacement element, the conveying chamber has a maximum volume $V_{max}$, the conveying chamber being connected by a pressure valve to the pressure line and by a suction valve to the suction line, so, by an oscillating movement of the displacement element, metering medium can alternately be sucked out of the suction line via the suction valve into the conveying chamber and metering medium can be discharged from the conveying chamber via the pressure valve into the pressure line. In order to provide a metering system and a metering pump adapted for this, which has a high degree of efficiency, exhibits no leakage flow and is simply constructed, it is proposed according to the invention that $$\frac{V_{max}}{V_{min}} > \sqrt[\kappa]{\frac{P_d}{P_s}},$$

Figure 1:
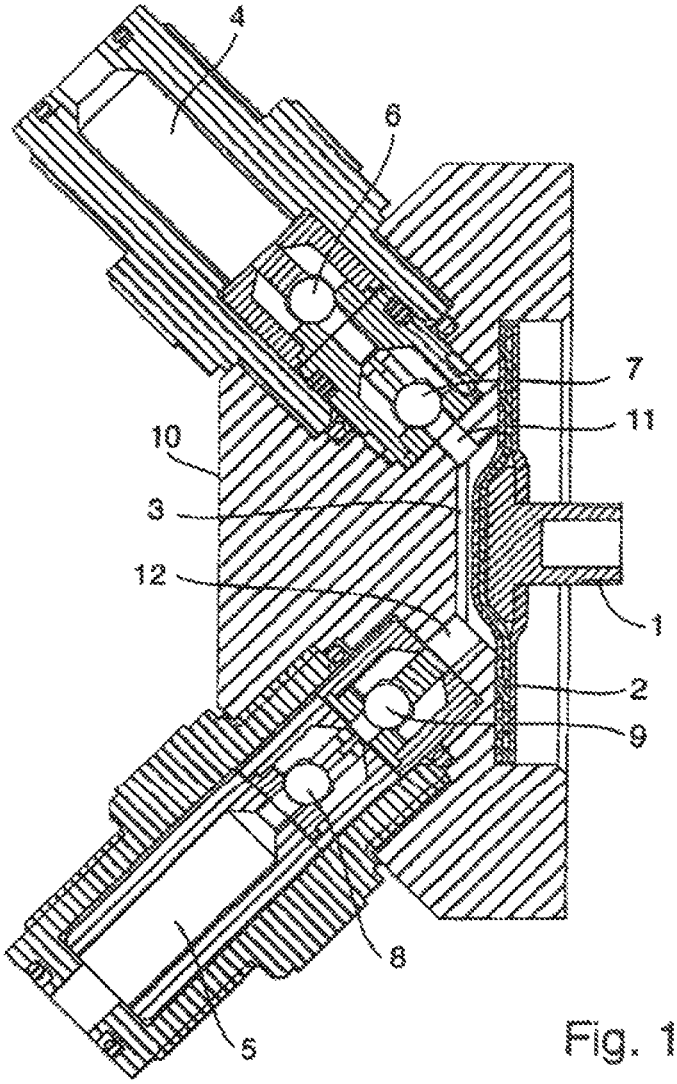

wherein $\kappa=1.5$.

19 Claims, 2 Drawing Sheets

(56) References Cited

U.S. PATENT DOCUMENTS

| | | | | |
|---|---|---|---|---|
| 2008/0273997 | A1 | 11/2008 | Hembree | |
| 2009/0031821 | A1 * | 2/2009 | Rowan | F04B 1/29 73/861.74 |
| 2013/0058796 | A1 | 3/2013 | Gerz | |

FOREIGN PATENT DOCUMENTS

| | | | |
|---|---|---|---|
| DE | 10238600 | A1 | 3/2004 |
| EP | 1546557 | B1 | 7/2008 |
| EP | 2362102 | A1 | 8/2011 |
| WO | 8501993 | A1 | 5/1985 |
| WO | 9635876 | A1 | 11/1996 |

OTHER PUBLICATIONS

Martin Kratzeisen, DE 10 2012 106 848.8, Search Report, German Patent and Trademark Office, Feb. 18, 2013.

Agnes Wittmann-Regis, International Preliminary Examination Report, PCT/EP2013/065756, The International Bureau of the World Intellectual Property Organization, Jan. 27, 2013.

* cited by examiner

METERING SYSTEM AND METERING PUMP THEREFOR

CROSS-REFERENCE TO RELATED APPLICATION

This application is a 371 national stage application of International Application PCT/EP2013/065756, filed Jul. 25, 2013, and claims the priority of German Application No. 10 2012 106 848.8, filed on Jul. 27, 2012.

The present invention relates to a metering system for metering a liquid, metering medium, with a suction line, which is filled with a metering medium, at the liquid pressure $p_s$, and a pressure line, which is filled with the metering medium at the liquid pressure $p_d$, wherein the suction line is connected to the pressure line by a metering member configured as a metering pump. With the aid of the metering pump metering medium can then be conveyed from the suction line into the pressure line. For this purpose the metering pump has a conveying chamber, the volume of which can be changed with the aid of a movable displacement element, for example a diaphragm, in such a way that, in a first position of the displacement element, the conveying chamber has a minimum volume $V_{min}$ and, in a second position of the displacement element, the conveying chamber has a maximum volume $V_{max}$. In this case, the conveying chamber is connected by a pressure valve to the pressure line and by a suction valve to the suction line, so, by an oscillating movement of the displacement element, metering medium can alternately be sucked out of the suction line via the suction valve info the conveying chamber and metering medium can be discharged from the conveying chamber via the pressure valve into the pressure line.

Metering systems of this type and corresponding metering pumps have been known for a long time.

A metering pump configured as a diaphragm pump is described in EP 1 546 557 B1.

When metering liquids, in particular degassing conveying media, such as, for example, sodium hypochlorite (NaClO), air bubbles can form in the suction line connected to the suction connection and be sucked into the metering head. It is also possible for air bubbles to form in the conveying chamber. This is often the case after relatively long metering breaks, for example after a weekend. As the suction connection is connected to a suction line, which, in the simplest case, is configured as a hose and ends in a storage container, when exchanging the storage container, in particular when the pump is running, it may occur that the suction line is briefly no longer connected to the conveying medium and sucks in air.

If too much gas is in the conveying chamber of an oscillating conveying pump, disturbances of the metering process may occur if the pump's own compressibility, due to the gas volume enclosed, is no longer sufficient to open the pressure valve against the liquid pressure $p_d$ and optionally against the return spring and the closing body of the pressure valve's own weight. In other words, it may occur that when the proportion of gas in the conveying chamber becomes too high, the pressure in the conveying chamber does not increase sufficiently, despite the movement of the displacement element from the second info the first position, to open the pressure valve connected to the pressure connection. The reason for toss is the high compressibility of gas compared to liquids.

Therefore, if the displacement element is no longer able to apply an adequately high pressure to open the pressure valve, the conveying medium is not pumped, in other words the desired metering cannot take place.

In order to be able to leave this error state, it is necessary to restore the compressibility to the counter-pressure $p_d$ applied at the pressure connection.

Various solution approaches are known for this. In the simplest case, the metering pump has a screwable venting opening to the conveying chamber that can be opened manually so the metering pump briefly does not have to work against the liquid pressure $p_d$, but against the ambient pressure, so the gas present in the conveying chamber can escape via the venting opening. The drawback of this method is, however, that a manual intervention is necessary.

A further solution is to equip corresponding venting openings with an actively activatable valve and to open this valve at periodic intervals. However, this method has the drawback that the venting opening is also opened when no gas is in the conveying chamber and therefore a certain leakage flow of the conveying medium occurs.

On the other hand, in the conveying pump shown in EP 1 546 557 B1 an additional connection is provided between the conveying chamber, on the one hand, and the pressure connection, on the other hand, which is opened intermittently in order to allow liquid to re-enter the conveying chamber from the pressure line, whereby gas can simultaneously escape from the conveying chamber so the ratio between compressible gases and incompressible liquids can be improved again and, ideally, the counter-pressure $p_d$ applied at the pressure connection can be reached again in the conveying chamber.

This solution is, however, relatively laborious, as, in addition to an additional bypass line, a valve closing the latter and an activating device to activate the valve have to be provided. In addition, the intermittent opening of the bypass valve reduces the efficiency of the pump as the opening also takes place when no gas is contained in the conveying chamber.

Proceeding from the described prior art, it is the object of the present invention to provide a metering system and a metering pump adapted for this, which has a high degree of efficiency, does not exhibit a leakage flow and which is simply constructed.

With regard to the metering system, this object is achieved in that $$\frac{V_{max}}{V_{min}} > \sqrt[\kappa]{\frac{P_d}{P_s}},$$

wherein $\kappa=1.5$.

The exponent $\kappa$ is also designated an adiabatic exponent and is a physical variable, which describes the ratio of the specific heat capacity of a medium at constant pressure to the specific heat capacity of the medium at constant volume. The value $\kappa$ is different for each gas and, in addition, also temperature-dependent. However, it has been shown that a value of 1.5 can be used for $\kappa$ in order to include all the applications relevant in practice. As already mentioned at the outset, the displacement element has to work against the counter-pressure, i.e. the pressure $p_d$ on the pressure line. As the conveying chamber is generally connected by means of a check valve to the pressure line, the displacement element additionally has to work against the spring of the check valve and, optionally—depending on the arrangement of the closing body of the valve—against the weight force of the closing body.

According to the invention, the ratio of the maximum volume $V_{max}$ and the minimum volume $V_{min}$ of the conveying chamber is therefore selected to be so great that even when the conveying chamber is completely filled with air, the necessary pressure $p_d$ can be reached. In most cases, the liquid pressure of the metering medium in the suction line $p_s$ will correspond to atmospheric pressure, but applications are also conceivable, in which the suction line is already under excess or negative pressure.

The ratio between $V_{max}$ and $V_{min}$ therefore depends on the liquid pressure $p_d$ to be expected in the pressure line.

In a preferred embodiment, me metering system in the pressure line has a liquid pressure $p_d$>7 bar, preferably $p_d$>10 bar and at best $p_d$>16 bar. In particular, a reliable venting is advantageous for a precise metering in the case of high liquid pressures of this type.

For typical applications, it is provided in a preferred embodiment that $$\frac{V_{max}}{V_{min}} \geq 4,$$

preferably $$\frac{V_{max}}{V_{min}} \geq 6$$

and at best $$\frac{V_{max}}{V_{min}} \geq 8.$$

Functionally reliable metering systems for the overwhelming number of applications can be achieved with the ratios mentioned.

With regard to the metering pump for use in the described metering system according to the invention, the object is achieved in that $$\frac{V_{max}}{V_{min}} \geq 4,$$

preferably $$\frac{V_{max}}{V_{min}} \geq 6$$

and at best $$\frac{V_{max}}{V_{min}} \geq 8.$$

It is ensured by the corresponding selection of the ratio between the maximum volume and the minimum volume of the conveying chamber that a metering system, in which the metering pump is used, for most applications ensures that even when the conveying chamber is completely filled with air, the metering pump's own compressibility is large enough to convey the air from the conveying chamber against the liquid pressure $p_d$ of the pressure line.

In a particularly preferred embodiment of the metering pump, it is provided that between the first position and the second position of the displacement element there is provided a third position of the displacement element, in which the conveying chamber has a working volume $V_A$, wherein $V_{min}<V_A<V_{max}$ and the metering pump has two operating modes, wherein in a metering mode, the displacement element is moved back and forth between the first and the second position or between the second and the third position, and in a venting mode, it is moved back and forth between the first and the second position.

In other words, the maximum stroke volume ($V_{max}-V_{min}$) is only reached during the venting mode, the stroke volume only being ($V_{max}-V_A$) or ($V_A-V_{min}$) during the normal metering mode.

A smaller stroke volume and, accompanying this, a smaller stroke of the displacement element, can lengthen the service life of the displacement element, in particular when the displacement element is configured as a diaphragm, it is therefore provided in a preferred embodiment that the maximum stroke only fakes place in the venting mode, while only a reduced stroke takes place in the metering mode.

In a preferred embodiment, a device is therefore provided, which briefly switches the metering pump into the venting mode at regular time intervals. For example, the metering pump could be switched into the venting mode for one stroke for every fiftieth or every two hundredth stoke, whereby gaseous medium possibly located in the conveying chamber is reliably pressed out of the conveying chamber.

As an alternative to this, the metering pump can also have a device for detecting a gaseous medium in the conveying chamber, so a control device may be provided, which switches the metering pump into the venting mode when the defection device detects gaseous medium in the head.

Figure 2:
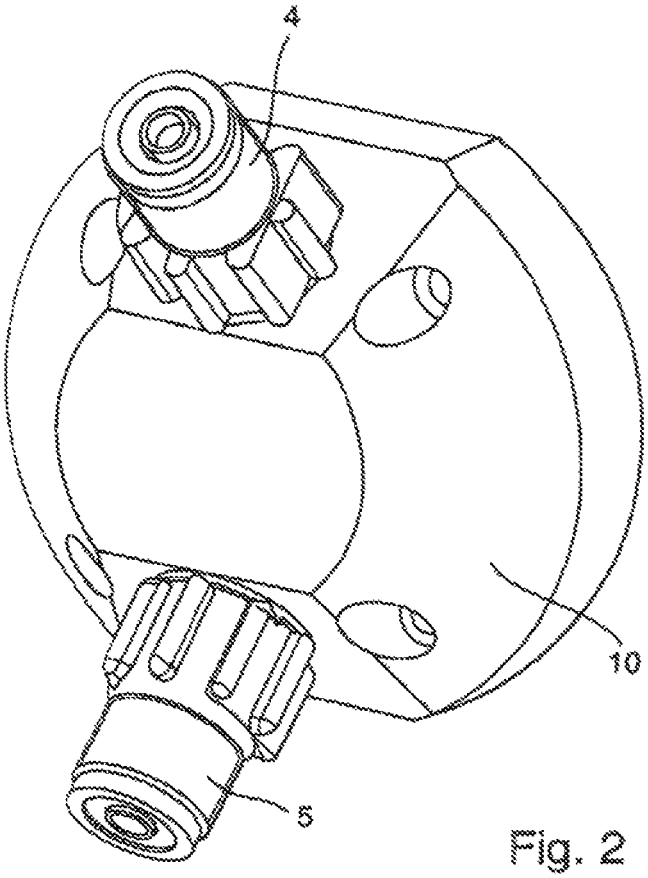

Further advantages, features and application possibilities become clear with the aid of the following description of a preferred embodiment and the associated figures, in which:

FIG. 1 shows a cross section through a metering head of a metering pump according to the invention and FIG. 2 shows a perspective plan view of the embodiment shown in FIG. 1.

FIG. 1 shows a sectional view through a metering head of an embodiment of a metering pump according to the invention. The metering head 10 has a displacement element 1, which is connected to a diaphragm 2. By means of the movement of the displacement element 1, the diaphragm 2 is moved back and forth so the volume of the conveying chamber 3 changes. The conveying chamber 3 is connected to a suction connection 5 by means of two check valves 8, 9, which are connected in series and form the suction valve. A suction line of a metering system may, for example, be connected to the suction connection 5, so metering medium is sucked from the suction line into the conveying chamber 3 when the diaphragm 2 together with the displacement element 1 moves in such a way that the volume of the conveying chamber 3 is increased.

The conveying chamber 3 is also connected to a pressure connection 4 by means of two check valves 6, 7, which are arranged in series and together form the pressure valve. The pressure connection can be connected to the pressure line of a metering system so that when the diaphragm 2 together with the displacement element 1 is moved in such a way that the volume of the conveying chamber 3 is reduced, metering medium is pressed via the two check valves 6, 7 and the pressure connection 4 into the pressure line.

A perspective view of the metering head 10 can be seen in FIG. 2 and both the pressure connection 4 and the suction connection 6 are seen.

The conveying chamber 3, on the one hand, consists of the chamber, in which the diaphragm moves back and forth and, on the other hand, of a pressure channel 11, which connects the diaphragm chamber to the check valve 7, as well as the suction channel 12, which connects the diaphragm chamber to the check valve 9. Both the pressure channel 11 and the suction channel 12 form part of the convoying chamber volume. The minimum volume $V_{min}$ of the conveying chamber 3, which can be adjusted with the aid of the movable diaphragm 2, therefore consists at least of the volume of the pressure channel 11 and the volume of the suction channel 12.

In order to select the minimum volume $V_{min}$ of the conveying chamber to be as small as possible, both the pressure channel 11 and the suction channel 12 are arranged here transversely to the movement direction of the displacement element 1, in other words, the movement direction of the displacement element encloses an angle of about 45° with the movement direction of a closing element of the pressure valve and with the movement direction of a closing element of the suction valve.

In the embodiment shown, the ratio $V_{max}/V_{min}$ is about 3. This ratio may, however, be selected to be still greater if the metering pump is to pump against high pressures.

LIST OF REFERENCE NUMERALS

1 displacement element
2 diaphragm
3 conveying chamber
4 pressure connection
5 suction connection
6, 7 check valves
8, 9 check valves
10 metering head
11 pressure channel
12 suction channel

The invention claimed is:

1. Metering system for metering a liquid metering medium, with a suction line, which is filled with a metering medium at the liquid pressure $p_s$, and a pressure line, which is filled with the metering medium at the liquid pressure $p_d$, wherein the suction line is connected to the pressure line by a metering member configured as a metering pump, with which metering medium can be conveyed from the suction line into the pressure line, wherein the metering pump has a conveying chamber, the volume of which can be changed with the aid of a movable displacement element in such a way that, in a first position of the displacement element, the conveying chamber has a minimum volume $V_{min}$ and, in a second position of the displacement element, the conveying chamber has a maximum volume $V_{max}$, the conveying chamber being connected by a pressure valve to the pressure line and by a suction valve to the suction line, so, by an oscillating movement of the displacement element, metering medium can alternately be sucked out of the suction line via the suction valve into the conveying chamber and metering medium can be discharged from the conveying chamber via the pressure valve into the pressure line, characterised in that $$\frac{V_{max}}{V_{min}} > \sqrt[\kappa]{\frac{P_d}{P_s}},$$

wherein $\kappa=1.5$.

2. Metering system according to claim 1, characterised in that $$\frac{V_{max}}{V_{min}} \geq 4.$$

3. Metering system according to claim 1, characterised in that the liquid pressure $p_d>7$ bar.

4. Metering pump for use in a metering system according to claim 1, which has a conveying chamber, the volume of which can be changed with the aid of a movable displacement element in such a way that, in a first position of the displacement element, the conveying chamber has a minimum volume $V_{min}$ and, in a second position of the displacement element, the conveying chamber has a maximum volume $V_{max}$, wherein the conveying chamber is connected by a pressure valve to a pressure connection for connection to a pressure line and is connected by a suction valve to a suction connection for connection to a suction line, characterised in that $$\frac{V_{max}}{V_{min}} \geq 4.$$

5. Metering pump according to claim 3, characterised in that provided between the first position and the second position of the displacement element is a third position of the displacement element, in which the conveying chamber has a working volume $V_A$, wherein $V_{min}<V_A<V_{max}$, and the metering pump has two operating modes, wherein, in a one operating mode, the displacement element is moved back and forth between the second and third position and, in a venting mode, it is moved back and forth between the first and the second position.

6. Metering pump according to claim 4, characterised in that a device is provided, which briefly switches the metering pump into the venting mode at regular time intervals.

7. Metering pump according to claim 4, characterised in that a device is provided for detecting a gaseous medium in the conveying chamber and a device is provided, which switches the metering pump into the venting mode when the detection device detects gaseous medium in the head.

8. Metering pump according to claim 3, characterised in that the movement direction of the displacement element encloses an angle between 15° and 85°, preferably between 30° and 60° and at best between 40° and 50° with the movement direction of a closing element of the pressure valve and/or with the movement direction of a closing element of the suction valve.

9. Metering system according to claim 1, characterised in that $$\frac{V_{max}}{V_{min}} \geq 6.$$

10. Metering system according to claim 1, characterised in that $$\frac{V_{max}}{V_{min}} \geq 8.$$

11. Metering system according to claim 1, characterised in that the liquid pressure $p_d>10$.

12. Metering system according to claim 1, characterised in that the liquid pressure $p_d>16$.

13. Metering pump for use in a metering system according to claim 1, which has a conveying chamber, the volume of which can be changed with the aid of a movable displacement element in such a way that, in a first position of the displacement element, the conveying chamber has a minimum volume $V_{min}$ and, in a second position of the displacement element, the conveying chamber has a maximum volume $V_{max}$, wherein the conveying chamber is connected by a pressure valve to a pressure connection for connection to a pressure line and is connected by a suction valve to a suction connection for connection to a suction line, characterised in that $$\frac{V_{max}}{V_{min}} \geq 6.$$

14. Metering pump for use in a metering system according to claim 1, which has a conveying chamber, the volume of which can be changed with the aid of a movable displacement element in such a way that, in a first position of the displacement element, the conveying chamber has a minimum volume $V_{min}$ and, in a second position of the displacement element, the conveying chamber has a maximum volume $V_{max}$, wherein the conveying chamber is connected by a pressure valve to a pressure connection for connection to a pressure line and is connected by a suction valve to a suction connection for connection to a suction line, characterised in that $$\frac{V_{max}}{V_{min}} \geq 8.$$

15. Metering pump according to claim 4, characterised in that the movement direction of the displacement element encloses an angle between 15° and 85°, preferably between 30° and 60° and at best between 40° and 50° with the movement direction of a closing element of the pressure valve and/or with the movement direction of a closing element of the suction valve.

16. Metering pump according to claim 5, characterised in that the movement direction of the displacement element encloses an angle between 15° and 85°, preferably between 30° and 60° and at best between 40° and 50° with the movement direction of a closing element of the pressure valve and/or with the movement direction of a closing element of the suction valve.

17. Metering pump according to claim 6, characterised in that the movement direction of the displacement element encloses an angle between 15° and 85°, preferably between 30° and 60° and at best between 40° and 50° with the movement direction of a closing element of the pressure valve and/or with the movement direction of a closing element of the suction valve.

18. Metering pump according to claim 13, characterised in that provided between the first position and the second position of the displacement element is a third position of the displacement element, in which the conveying chamber has a working volume $V_A$, wherein $V_{min}<V_A<V_{max}$, and the metering pump has two operating modes, wherein, in a one operating mode, the displacement element is moved back and forth between the second and third position and, in a venting mode, it is moved back and forth between the first and the second position.

19. Metering pump according to claim 14, characterised in that provided between the first position and the second position of the displacement element is a third position of the displacement element, in which the conveying chamber has a working volume $V_A$, wherein $V_{min}<V_A<V_{max}$, and the metering pump has two operating modes, wherein, in a one operating mode, the displacement element is moved back and forth between the second and third position and, in a venting mode, it is moved back and forth between the first and the second position.

* * * * *